US006772803B2

(12) United States Patent
Awad

(10) Patent No.: US 6,772,803 B2
(45) Date of Patent: Aug. 10, 2004

(54) POWER STEERING FLUID EXCHANGE SYSTEM AND METHOD OF USE

(76) Inventor: Adam Awad, 160 Fairhaven La., Costa Mesa, CA (US) 92626

( * ) Notice: Subject to any disclaimer, the term of this patent is extended or adjusted under 35 U.S.C. 154(b) by 0 days.

(21) Appl. No.: 10/634,271

(22) Filed: Aug. 4, 2003

(65) Prior Publication Data

US 2004/0084105 A1 May 6, 2004

Related U.S. Application Data

(63) Continuation-in-part of application No. 10/287,574, filed on Nov. 4, 2002, now Pat. No. 6,688,340.

(51) Int. Cl.[7] ..... B65B 31/04

(52) U.S. Cl. ..... 141/65; 141/7; 141/59; 141/98; 184/1.5

(58) Field of Search ..... 141/7, 37, 39, 141/59, 65, 95, 98; 184/1.5

(56) References Cited

U.S. PATENT DOCUMENTS

| | | | | |
|---|---|---|---|---|
| 4,408,960 A | | 10/1983 | Allen | 417/54 |
| 5,318,080 A | | 6/1994 | Viken | 141/98 |
| 5,415,247 A | | 5/1995 | Knorr | 184/1.5 |
| 5,427,505 A | | 6/1995 | Payne | 417/149 |
| 5,520,518 A | | 5/1996 | Taguchi | 417/54 |
| 5,738,499 A | | 4/1998 | Evans | 417/148 |
| 5,746,259 A | * | 5/1998 | Noble, III | 141/92 |
| 5,806,629 A | | 9/1998 | Dixon et al. | 184/1.5 |
| 5,853,068 A | | 12/1998 | Dixon et al. | 184/1.5 |
| 6,035,902 A | | 3/2000 | Dixon | 141/98 |
| 6,062,275 A | * | 5/2000 | Rome et al. | 141/98 |
| 6,247,509 B1 | | 6/2001 | Rome et al. | 141/98 |
| 6,286,626 B1 | | 9/2001 | Evans | 184/1.5 |
| 6,378,657 B2 | | 4/2002 | Viken | 184/1.5 |
| 6,382,271 B1 | | 5/2002 | Betancourt et al. | 141/98 |
| 6,688,340 B1 | * | 2/2004 | Awad | 141/65 |

* cited by examiner

*Primary Examiner*—Gregory L. Huson
*Assistant Examiner*—Peter deVore
(74) *Attorney, Agent, or Firm*—Gene Scott; Patent Law & Venture Group

(57) ABSTRACT

Interconnecting a fluid interchange apparatus with a power steering system of a vehicle; pumping spent fluid from the power steering system into a fluid receiving container to compress air pressure therein; interconnecting, with a pressure actuated valve, the fluid receiving container and a replacement fluid container, the replacement fluid container holding a replacement fluid; automatically opening the pressure actuated valve when a selected amount of the spent fluid from the power steering system is transferred into the fluid receiving container resulting in an air pressure sufficient to open the pressure actuated valve; and draining, under the force of the sufficient air pressure, the replacement fluid from the replacement fluid container into the power steering system to replace the spent fluid in the power steering system with the replacement fluid.

16 Claims, 3 Drawing Sheets

POWER STEERING FLUID EXCHANGE SYSTEM AND METHOD OF USE

RELATED APPLICATIONS

This is a continuation-in-part application of a prior filed application having Ser. No. 10/287,574 and file date of Nov. 4, 2002 now U.S. Pat. No. 6,688,340.

INCORPORATION BY REFERENCE:

Applicant(s) hereby incorporate herein by reference, any and all U.S. patents, U.S. patent applications, and other documents and printed matter cited or referred to in this application.

BACKGROUND OF THE INVENTION

1. Field of the Invention

This invention relates generally to automotive fluid systems and methods of use and more particularly to a power steering fluid exchange system and method of use.

2. Description of Related Art

The following art defines the present state of this field:

Allen, U.S. Pat. No. 4,408,960 describes a pneumatic method and apparatus for causing the rapid recirculation of a liquid between a plurality of containers by adjusting the pressure of a gas exerted within each of said containers to super-atmospheric, atmospheric and sub-atmospheric pressures, thereby avoiding the passing of the liquid through a mechanical flow-inducing pump. The containers are connected to each other by means of a liquid circulation system comprising a circulation conduit which includes a work station. A filled first container is subjected to super-atmospheric pressure to force the liquid into the circulation system while a second empty container is subjected to sub-atmospheric pressure to suck the liquid from the circulation system. After each container is empty and before it is subjected to sub-atmospheric pressure, for refilling purposes, it is exposed to atmospheric pressure to release the elevated pressure therefrom. The circulation system preferably incorporates a bypass conduit including a liquid replenishment tank and/or means for adjusting the temperature of the liquid.

Viken, U.S. Pat. No. 5,318,080 describes fluid changing in an automatic transmission by opening the cooler line and draining used fluid, at the flow of normal circulation, out of the cooler line from the transmission into a drain receptacle for receiving used fluid and simultaneously supplying fresh fluid, from a pressurized supply receptacle, into the cooler return line to the transmission at a similar controlled rate that is equal or greater than the rate of flow of the used fluid into the drain receptacle.

Knorr, U.S. Pat. No. 5,415,247 describes an automotive fluid exchange system wherein new fluid (such as power steering fluid) is simultaneously exchanged with the used fluid. First and second fluid conduits having first and second pumps disposed therein, respectively, provide the passageway between an engine compartment and a container for the new and used fluid, respectively. The two pumps are selectively actuatable by a respective, conventional toggle switch. Conventional jumper cables provide the power supply means to drive the pumps.

Payne, U.S. Pat. No. 5,427,505 describes an apparatus for extracting and injecting liquid coolant from and into a reservoir for an engine cooling system. The apparatus includes a storage tank for the liquid coolant, and an air pressure system for selectively applying fluid pressure to the tank either above or below atmospheric pressure. A hose connects the tank to the engine cooling system reservoir through a double shut-off-type coupling. One part of the coupling is connected to the reservoir, and the other, to the end of the transfer hose each having its own independent shut-off valve. When the coupling is connected, the valves in both components are opened and conversely when the coupling is disconnected, the valves automatically close.

Taguchi, U.S. Pat. No. 5,520,518 describes a method of transferring fluent material transferring the material from a first pressure tank to a fluent material transfer destination by supplying compressed gas to the first tank through a compressor. The compressed gas is retained in the first tank for reuse. Additional fluent material is drawn into a second pressure tank and is transferred therefrom to the fluent material transfer destination by supplying the compressed gas from the first pressure tank to the second pressure tank through the compressor. The compressed gas is further retained in the second pressure tank transferring fluent material from the first pressure tank. As the compressed gas is emptied from each tank to the other tank, additional fluent material is drawn into that tank. The cycle can be repeated on a continuous basis to transfer large quantities of fluent material.

Evans, U.S. Pat. No. 5,738,499 describes a fluid delivery/extracting device for extracting fluid from and delivering fluid to a reservoir of a vehicle. The device includes a cylindrical body formed from a tube, a bottom member and a top member. The top member comprises an annular member and a closure which closes the annular member. A pair of fittings extending through the closure, one of which has a portion extending below the closures top surface. A dip tube is applied to the this fitting and extends nearly to the bottom of the container. A first hose extends from the first fitting outer portion to a reservoir to be filled or emptied and is sufficiently long to extend to the bottom of the reservoir. A second hose extends from the second fitting and is connectable to any vacuum port of a vehicle if the device is to be used to empty the reservoir, or to a supply of pressurized air, if the device is to be used to fill the reservoir. The device makes it fairly simple to extract fluid from and deliver fluid to even hard to reach reservoirs, and reservoirs which are filled with highly viscous fluids.

Dixon et al., U.S. Pat. No. 5,806,629 describes a fail-safe transmission service machine allowing old ATF to be pumped out of a transmission while the vehicle engine runs, and responsively pumps a matching volume of new ATF into the transmission so that dry running of the transmission can not occur. If the supply of new ATF runs out or if power to the service machine is interrupted, the machine reverts to closed loop fluid circulation for the transmission. A hydraulic rectifier provides for universal connection of hoses between the transmission cooler fluid circulation loop of the vehicle and the service machine. An alternative embodiment of the machine allows for similarly fail-safe exchange of power steering fluid from a vehicle, and replacement of the old fluid with new power steering fluid.

Dixon et al., U.S. Pat. No. 5,853,068 describes an automotive fluid service machine for changing fluids such as automatic transmission fluid, power steering fluid, and engine coolant, including a cabinet with a unitary integral fluid reservoir defined by a, lower portion of the machine cabinet. This lower cabinet portion which integrally defines the fluid reservoir also provides a machinery deck to which the components of the machines are mounted. A cap portion of the cabinet provides a cavity for protecting the components mounted to the machinery deck and also provides a control panel for the machine in addition to providing fluid fill and drainage basins improving the convenience and safety of use for the machine. The safety of a service area is improved by the machine because a very low center of gravity for the machine reduces the risk of tipping of a machine and of spilling fluids. Thus, environmental concerns from such spills as well as the risk of personnel slips and falls on spilled fluids are reduced.

Dixon, U.S. Pat. No. 6,035,902 describes a fail-safe service machine for the power steering system of automotive vehicles including a pair of pumps each driven by electrical power from a vehicle under service, and a suction/delivery probe extending into the power steering system reservoir of the vehicle, both to remove old power steering fluid, and to simultaneously deliver new power steering fluid Rome et al., U.S. Pat. No. 6,062,275 describes an apparatus and method of replacing old fluid in a transmission system by feeding clean fluid into the system from a clean fluid tank using a pump and draining the old fluid into a waste tank and using a processor to monitor the clean fluid pressure in the clean tank and the old fluid pressure in the waste tank and adjusting the pump's speed using the processor such that the old fluid is drained at substantially the same rate as the clean fluid is fed.

Rome et al., U.S. Pat. No. 6,247,509 describes and apparatus and method of replacing old fluid in a transmission system by feeding clean fluid into the system from a clean fluid tank using a pump and draining the old fluid into a waste tank and using a processor to monitor the clean fluid pressure in the clean tank and the old fluid pressure in the waste tank and adjusting the pump's speed using the processor such that the old fluid is drained at substantially the same rate as the clean fluid is fed.

Evans, U.S. Pat. No. 6,286,626 describes an automated system for changing the motor oil in an engine. The system includes a drain plug having a plurality of channels coupled with tubing that extends to a reversible pump. Tubing extends from the pump to both a used oil container and a new oil container. Check valves positioned at the entrance of each container restrict flow so the oil can flow only to the used oil container and only flows from the new oil container. Preferably, both containers are located in the trunk of the vehicle for easy access. In use, the pump is engaged to draw the used motor oil from the engine into the used oil container. Next, the pump is reversed to draw fresh oil from the new oil container into the engine.

Viken, U.S. Pat. No. 6,378,657 describes fluid changing in an automatic transmission by opening the cooler line and draining used fluid, at the flow of normal circulation, out of the cooler line from the transmission into a drain receptacle for receiving used fluid and simultaneously supplying fresh fluid, from a pressurized supply receptacle into the cooler return line to the transmission at a similar controlled rate that is equal or greater than the rate of flow of the used fluid into the drain receptacle.

Betancourt et al., U.S. Pat. No. 6,382,271 describes an apparatus and method of replacing old fluid in a transmission system by feeding clean fluid into the system from a clean fluid tank using a pump and draining the old fluid into a waste tank and using a processor to monitor the clean fluid pressure in the clean tank and the old fluid pressure in the waste tank and adjusting the pump's speed using the processor such that the old fluid is drained at substantially the same rate as the clean fluid is fed.

The prior art teaches the use of carts for providing automotive maintenance and especially in the field of power steering fluid exchange, but does not teach a system with the combination of features and automated controllability of the present invention. The present invention fulfills these needs and provides further related advantages as described in the following summary.

SUMMARY OF THE INVENTION

The present invention teaches certain benefits in construction and use which give rise to the objectives described below.

An apparatus for changing power steering fluid in an automotive power steering system, uses the components of an fluid receiving container; an fluid supply container; a utility fluid pump, a pressure actuated fluid valve; and, a fluid conducting means. The components are arranged such that air is compressed in the fluid receiving container by entry of spent power steering fluid and builds to open the pressure actuated valve when about 80–90 percent of the spent fluid has been drawn out of the power steering system, so as to drive replacement power steering fluid into the power steering system, replacing the spent fluid.

A primary objective of the present invention is to provide an apparatus and method of use of such apparatus that provides advantages not taught by the prior art.

Another objective is to provide such an invention capable of moving fluids between containers and an automotive power steering system in such a manner that when a selected percent of the spent fluid is removed, only then, will replacement fluid be driven into the power steering system.

A further objective is to provide such an invention capable of quick and easy change of power steering fluid without excessive skill or supervision.

A further objective is to provide such an invention capable of system pressurization used for remote, off-site, draining of power steering fluids.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawing illustrates the present invention. In such drawing.

DETAILED DESCRIPTION OF THE INVENTION

The above described drawing figures illustrate the invention in at least one of its preferred embodiments, which is further defined in detail in the following description.

Figure 2:
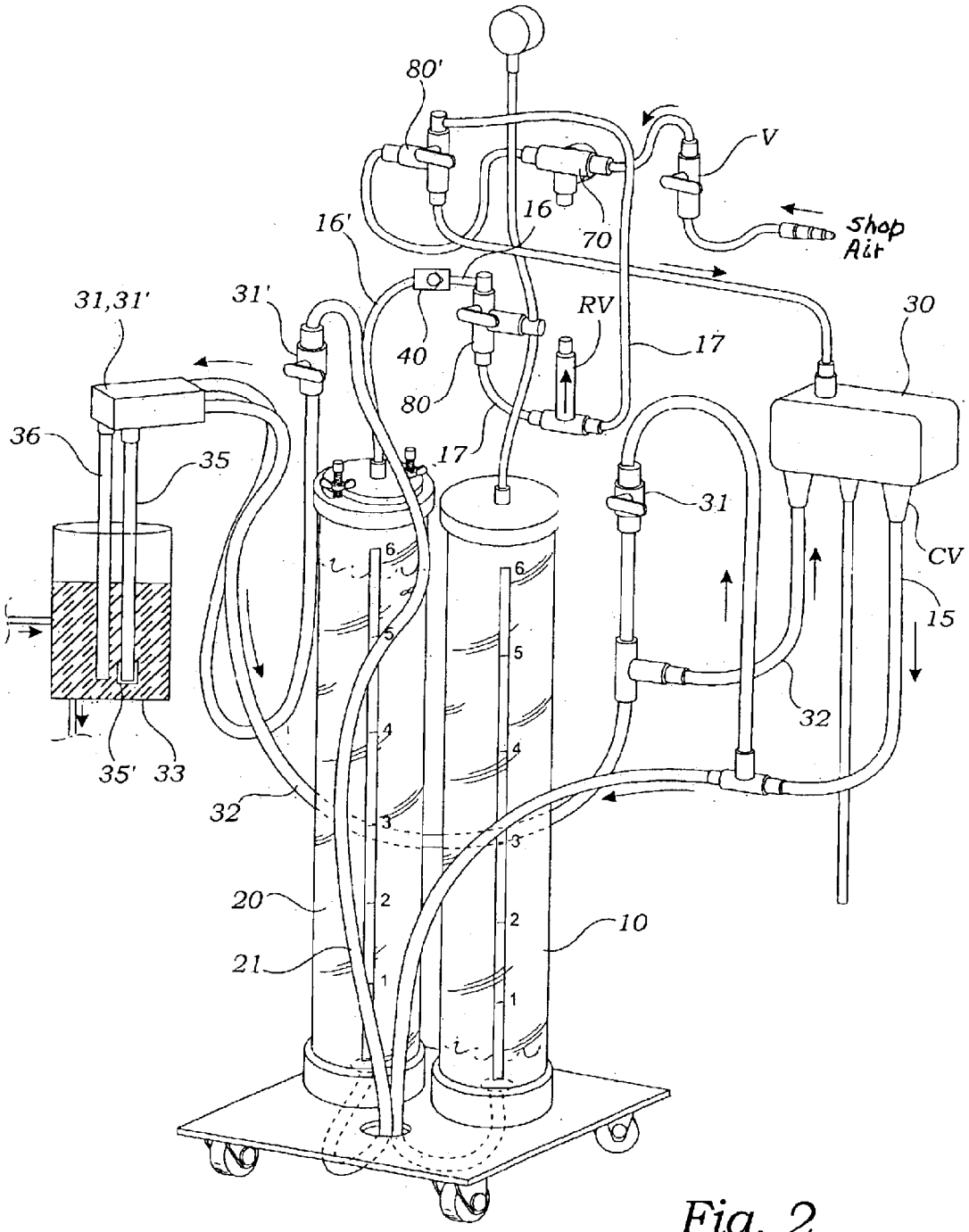
FIG. 2 is an exploded perspective view of FIG. 1, showing the internal fluid conductors thereof and their interconnecting hardware elements.
Figure 3:
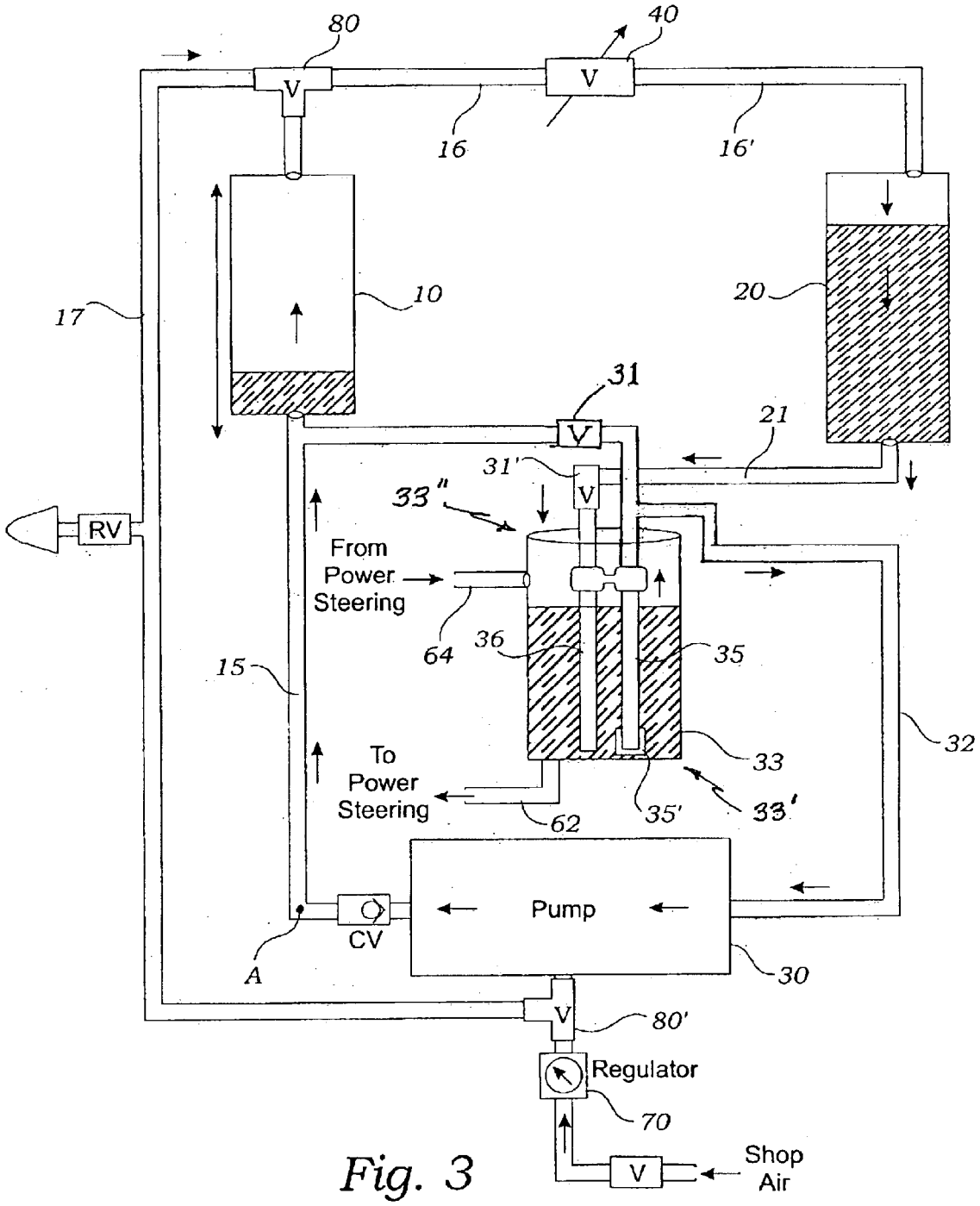
FIG. 3 is a schematic diagram thereof.

The present invention is an apparatus for changing power steering fluid in an automotive power steering system. Fluid is shown with cross-hatching in FIG. 2, but not in the interconnecting hoses. The fluid is referred to as "spent fluid" which is replaced by the method of this invention, and as "replacement fluid," which is substituted for the spent fluid. The vehicle's fluid reservoir is shown in FIG. 2 and identified with numeral 33. The vehicle's power steering pump is not shown, but it pulls (pumps) fluid from the reservoir 33 to the power steering unit, also not shown, through tube 62, and pushes the fluid back to the reservoir 33 through tube 64.

FIG. 2 shows the operating components of the invention including, a fluid receiving container 10, a fluid supply container 20, a utility fluid pump 30 which may be of any common type capable of pumping both air and a viscous liquid such as power steering fluid, a pressure actuated fluid valve 40, and fluid conducting conduits 15, 16, 16', 17, 21, 32 which are preferably plastic tubing of the type that is reinforced so as to prevent bulging under pressure and collapse under vacuum. The containers 10 and 20 are constructed so that fluids, including air, can only flow into and out of the containers via their ports. The interconnections between containers 10, 20 and the fluid conducting conduits are tight so as not to leak when subjected to the pressures necessary for operation of the invention as herein defined. Such construction is well known in the art and is of critical importance here as will be shown. The components of the invention are arranged such that fluids, both air and power steering fluid are forced to flow in the apparatus under pressures created by fluid pump 30. When the invention apparatus is engaged with the reservoir 33, as shown, spent fluid in the vehicle's power steering system is pumped from reservoir 33 by suction in tube 35 and line 32, into container 10 through check valve CV. Drain valve 31 is closed at this time. The novelty of this arrangement is that spent fluid flows into container 10 and this causes air in container 10 and line 16 to be slightly compressed because the system is tight, so that pressure in container 10 rises. Shutoff valve 80 is not open to tube 17 at this time. When a selected amount of the spent fluid from the vehicle's power steering system has flowed into container 10 its pressure and that in tube 16 reaches a level that automatically opens pressure actuated valve 40, i.e., valve 40 is adjustable and set for a selected pressure. Such pressure actuated valves are very well known in the art and are notoriously used as pressure relieve valve. When valve 40 opens, pressure in container 10 is relieved into container 20 which forces the flow of replacement fluid from container 20 into reservoir 33 through tube 21 and valve 31' which is open at this time. The sizes of the containers 10, 20 and of the tubes are such that 80–90% of spent fluid in the power steering system is removed before new replacement fluid starts to enter. One of skill in the art would have the capability to configure the tube sizes and lengths so that pressure adjustment at valve 40 is capable of accomplishing this result. As noted in FIG. 2, valve 40 is adjustable as to the pressure differential between tubes 16 and 16' at which it will open. With this facilitation, it is quite simple to adjust valve 40 to open when a selected amount of the spent fluid has been removed from reservoir 33. That is, upon first trials of the system, when the selected amount of spent fluid has been pumped from the power steering system, valve 40 is adjusted to open at the pressure differential that exists at that time between tubes 16 and 16'. This setting may thereafter remain unchanged for the invention to operate in the same manner in subsequent uses, assuming that the volume of each subsequent power steering system remains nearly the same. This is a critical and novel aspect of the invention and clearly results in a benefit of significant value, i.e., only 10–20% of the spent fluid is left to mix with replacement fluid.

Figure 1:
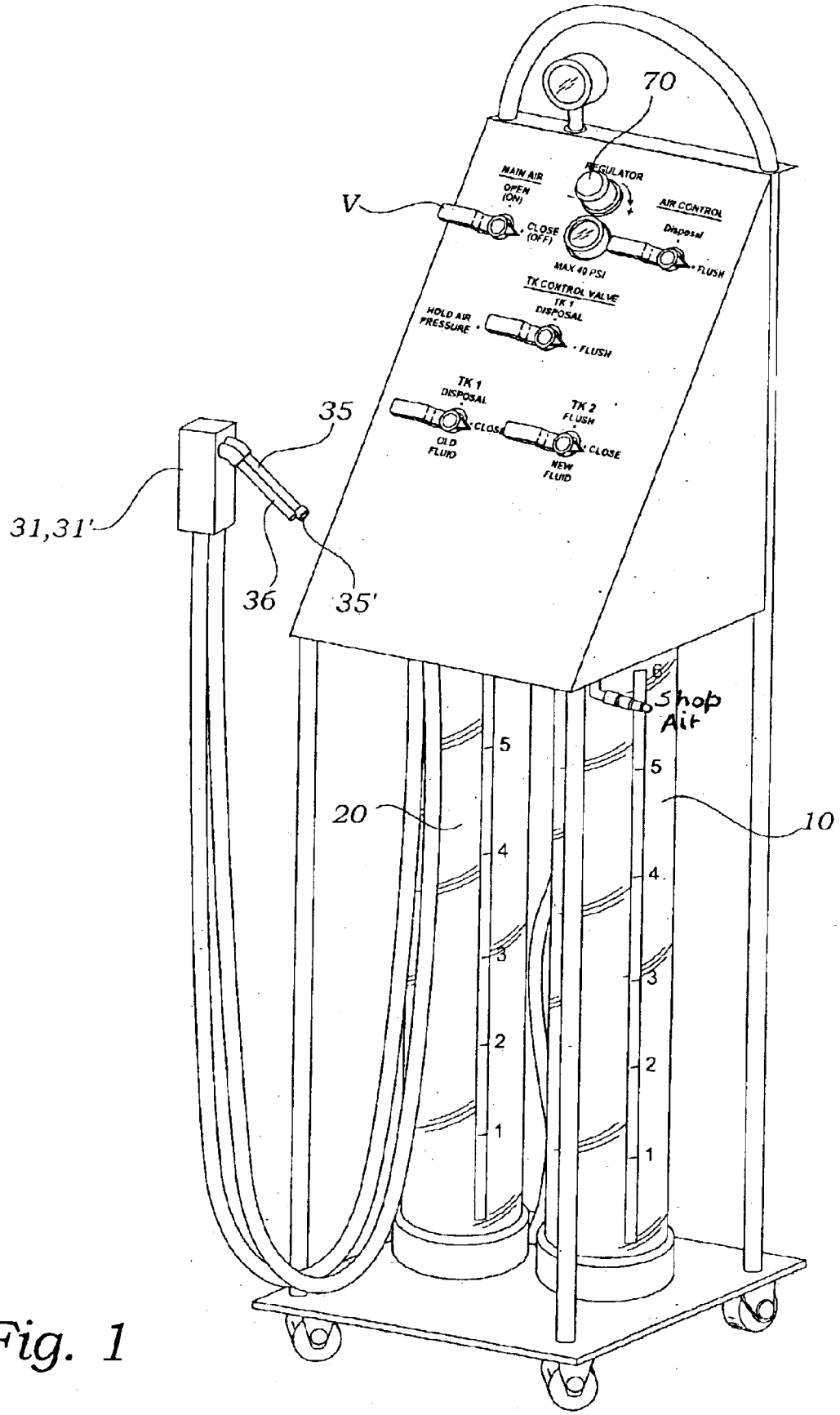
FIG. 1 is a perspective view of the preferred embodiment of the invention.

In an alternate embodiment of the invention, valve 40 is not used. However, the same result is accomplished by sizing and positioning the tubes 16, 16' and 21 and the containers 10, 20 such that the same result as described above is accomplished. Experimentation with tube conductances, pumping pressures and container volumes and relative elevational positions can easily converge on a system solution that operates without the valve 40 to achieve delayed fluid flow from the replacement container 20 relative to flow into the spent fluid container 10. FIG. 1 shows a system that provides the requisite configuration to achieve the objectives defined.

Removal of the spent fluid and insertion of the replacement fluid is accomplished without supervision; basically automatically. The process is conducted while the engine of the vehicle is running so that the fluid is drawn off and replaced in a continuous manner, e.g., while circulating through the vehicle's power steering system via lines 62 and 64 respectively. This has the advantage of assuring that most of the spent fluid is extracted from the system prior to inserting the replacement fluid. The pump 30 may be of any type capable of pumping fluid, and as shown in FIG. 2 it is preferably driven by a source of compressed air (shop air) through a regulator 70. Preferably the suction line tube 35 terminates with a magnetic suction nozzle 35' for capturing metal finds in the fluid. Such metal finds, i.e., metallic dust and other particles often tend to clog the power:steering lines and valves so that capture of this material is of importance. The magnetic suction nozzle comprises a steel screen mounted on the end of the suction tube 31 the steel screen stretched across a doughnut shaped magnet so that the entire screen provides magnetic attraction to metal particles in the fluid. During fluid flow through the screen, the metal particles adhere to the screen and may later be manually removed.

Shutoff valve 80, enables the use of shop air to pressurize containers 10 and 20 when necessary for draining fluids therefrom. To accomplish this, shop air is directed through regulator 70 and valve 80' into tube 17 to pressurize the containers 10, and/or 20 and at this time valves 31 and 31' are closed. Relief valve RV is used to assure that excessive pressure does not appear in tube 17. The tube assembly including suction tube 35 and delivery tube 36 is a simple, light weight assembly which is manually placed into reservoir 33 during fluid replacement, and removed from reservoir 33 for draining containers 10 and/or 20. With this assembly removed from reservoir 33 and placed into a disposal container (not shown) and with the opening of wither or both drain valves 31 and 31' (depending on which container is to be drained), the containers 10 and 20 are drained directly. The step of draining the containers 10, 20 is preferably accomplished by closing valves 31 and 31', pressurizing the containers 10 and 20 and then closing shutoff valve 80 thereby isolating containers 10, 20 while they are under pressure, whereupon the system (all shown in FIG. 2 except for vehicle reservoir 33) is then moved to a drainage site for disposal of the fluids, wherein the fluids in containers 10 and 20 are forced out by the pressure held in containers 10 and 20 through the valves 31 and/or 31'. No assistance from shop air is required for this forced draining. An alternate method of draining container 10 is to provide a two-way drain valve at point "A" in tube 15. Such a two-way drain valve in tube 15 at point "A" is plumbed to allow, in its first valve position, free fluid flow from pump 30 to container 10, and in its alternate valve position, drainage of container 10. Container 10 would be pressurized as described above prior to such draining.

In the preferred embodiment, containers 10 and 20 are about two feet in length and four inches in diameter, and the fluid tubes are 5/16 or 3/8 inch inside diameter. The pressure actuated valve 40 is set to open at a specified pressure in the range of 3–6 psi, and this combination has been shown to automatically extract about 80–90% of the spent fluid in a typical automotive power steering system which holds about 2 quarts of fluid, prior to starting delivery of the replacement fluid. Other combinations of container and tube sizes and length can be used in the present invention just as well, and the opening pressure at pressure actuated valve 40 can be set to start delivery of the replacement PS fluid at any desired stage in the process.

The method of the present invention further comprises the following steps for determining and controlling the amount of replacement fluid delivered to the system. These steps include: positioning the jointly engaged suction line tube 35 and the delivery tube 36, into the reservoir 33 of the power steering system, the suction line tube 35 positioned for sucking the spent fluid out of the reservoir 33 to the spent fluid container 10, and the delivery tube 36 is positioned for delivering the replacement fluid to the reservoir 33 from the replacement fluid container 20; and determining the amount of replacement fluid delivered to the reservoir 33 by placing the tubes 35, 36 alternately and cyclically adjacent to a bottom surface 33' of the reservoir 33 until the reservoir is empty, or nearly empty, and at an upper most position 33" in the reservoir 33 until the reservoir 33 is filled. If the reservoir holds a total of one quart, then delivering the replacement fluid to an empty reservoir 33 until it is filled results in a one quart delivery, and then sucking the reservoir 33 until empty again and refilling it results in a two quart delivery, and so on.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for replacing a spent fluid in a power steering system of a vehicle, the apparatus comprising the components of: a fluid receiving container for receiving the spent fluid; a replacement fluid container holding a replacement fluid; a fluid pump; a pressure actuated valve; and a means for conducting fluid; the components arranged and sized and interconnected tightly such that when the spent fluid is pumped from the power steering system into the fluid receiving container by the fluid pump, air pressure in the fluid receiving container rises opening the pressure actuated valve and forcing the replacement fluid from the replacement fluid container into the power steering system to replace the spent fluid therein; the pressure actuated valve being set to open only after a selected percent of the spent fluid has already been removed from the power steering system.

2. The apparatus of claim 1 wherein the pressure actuated valve and the fluid conducting means are sized and configured so that the pressure actuated valve opens when between 80 and 90 percent of the spent fluid has been transferred to the fluid receiving container.

3. The apparatus of claim 1 further comprising a shutoff valve positioned between a source of compressed air and the fluid receiving container for pressurizing thereof, and further comprising a fluid drain valve positioned between the fluid receiving container and the suction tube for enabling isolating of the fluid receiving container and for dispensing the spent fluid.

4. The apparatus of claim 1 further comprising a suction line tube terminating with a magnetic suction nozzle for capturing metal finds in the fluid.

5. A method for replacing a power steering fluid, the method comprising the steps of: interconnecting a fluid interchange apparatus with a power steering system of a vehicle; pumping spent fluid from the power steering system into a fluid receiving container to compress air pressure therein; interconnecting, with a pressure actuated valve, the fluid receiving container and a replacement fluid container, the replacement fluid container holding a replacement fluid; automatically opening the pressure actuated valve when a selected percent of the spent fluid from the power steering system is transferred into the fluid receiving container resulting in an air pressure sufficient to open the pressure actuated valve; and draining, under the force of the sufficient air pressure, the replacement fluid from the replacement fluid container into the power steering system to replace the spent fluid in the power steering system with the replacement fluid.

6. The method of claim 5 further comprising the steps of: mutually securing a suction tube and a delivery tube of the fluid interchange apparatus; engaging the suction and delivery tubes with the spent fluid of the power steering system of the vehicle; and applying suction to the suction tube to remove the spent fluid from the system.

7. The method of claim 6 comprising the further steps of: pressurizing the fluid receiving container, withdrawing the suction tube from the power steering system, and discharging the spent fluid in the fluid receiving container into a waste receptacle through the suction tube.

8. An apparatus for replacing a spent fluid in a power steering system of a vehicle, the apparatus comprising the components of: a fluid receiving container for receiving the spent fluid; a replacement fluid container holding a replacement fluid; a fluid pump; a pressure actuated valve; and a means for conducting fluid; the components arranged and sized and interconnected such that when the spent fluid is pumped from the power steering system into the fluid receiving container by the fluid pump, air pressure in the fluid receiving container rises forcing the replacement fluid from the replacement fluid container into the power steering system to replace the spent fluid therein; the placements and sizes of the components adapted so that the replacement fluid only starts to flow into the power steering system after a selected percent of the spent fluid has been already removed from the power steering system.

9. The apparatus of claim 8 wherein the placements and sizes of the components are adapted so that the flow rate of replacement fluid is less than the flow rate of the spent fluid.

10. The apparatus of claim 8 wherein the replacement fluid starts to flow into the power steering system when between 80 and 90 percent of the spent fluid has been transferred to the fluid receiving container.

11. The apparatus of claim 8 further comprising a shutoff valve positioned between a source of compressed air and the fluid receiving container for pressurizing thereof, and further comprising a fluid drain valve positioned between the fluid receiving container and the suction tube for enabling isolating of the fluid receiving container and for dispensing the spent fluid.

12. The apparatus of claim 8 further comprising a suction line tube terminating with a magnetic suction nozzle for capturing metal finds in the fluid.

13. A method for replacing a power steering fluid, the method comprising the steps of: interconnecting a fluid interchange apparatus with a power steering system of a vehicle; pumping spent fluid from the power steering system into a fluid receiving container to compress air pressure therein; interconnecting, the fluid receiving container and a replacement fluid container, the replacement fluid container holding a replacement fluid; positioning the containers and fluid conductors therebetween relative to the power steering system such that when a selected percent of the spent fluid from the power steering system is transferred into the fluid receiving container resulting air pressure in the spent fluid container is sufficient to start draining, under the force of the sufficient air pressure, the replacement fluid from the replacement fluid container into the power steering system to replace the spent fluid in the power steering system with the replacement fluid.

14. The method of claim 13 further comprising the steps of: mutually securing a suction tube and a delivery tube of the fluid interchange apparatus; engaging the suction and delivery tubes with the spent fluid of the power steering system of the vehicle; and applying suction to the suction tube to remove the spent fluid from the system.

15. The method of claim 13 comprising the further steps of: pressurizing the fluid receiving container, withdrawing the suction tube from the power steering system, and discharging the spent fluid in the fluid receiving container into a waste receptacle through the suction tube.

16. The method of claim 13 further comprising the steps of: positioning a suction line tube and a delivery tube, the tubes jointly engaged and movable, into a reservoir of the power steering system, wherein the suction line tube is positioned for sucking spent fluid out of the reservoir to the spent fluid container, and the delivery tube is positioned for delivering replacement fluid to the reservoir from the replacement fluid container; and determining the amount of fluid delivered to the reservoir by placing the tubes alternately and cyclically adjacent to a bottom surface of the reservoir until the reservoir is empty, and at an upper most position in the reservoir until the reservoir is filled.

* * * * *